US006432273B1

(12) United States Patent
Honkalampi et al.

(10) Patent No.: US 6,432,273 B1
(45) Date of Patent: Aug. 13, 2002

(54) FORMER-PRESS SECTION IN A PAPER MACHINE AND METHOD FOR TRANSFER OF THE WEB FROM THE FORMER TO THE PRESS SECTION

(75) Inventors: Petter Honkalampi, Muurame; Jorma Laapotti, Palokka, both of (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/743,080

(22) PCT Filed: Jun. 22, 1999

(86) PCT No.: PCT/FI99/00551

§ 371 (c)(1),
(2), (4) Date: Jan. 2, 2001

(87) PCT Pub. No.: WO00/01880

PCT Pub. Date: Jan. 13, 2000

(30) Foreign Application Priority Data

Jul. 1, 1998 (FI) ..... 981513

(51) Int. Cl.[7] ..... D21F 3/00; D21F 1/48; D21F 3/04

(52) U.S. Cl. ..... 162/205; 162/278; 162/358.1

(58) Field of Search ..... 162/204, 205, 162/275, 278, 306, 358.1, 358.3

(56) References Cited

U.S. PATENT DOCUMENTS

| | | | | |
|---|---|---|---|---|
| 2,622,492 A | * | 12/1952 | Goodwillie | 92/49 |
| 3,351,521 A | * | 11/1967 | Murray et al. | 162/307 |
| 4,197,158 A | | 4/1980 | Johnson | 162/305 |
| 4,879,001 A | | 11/1989 | Cronin | 162/206 |
| 5,308,450 A | | 5/1994 | Braun et al. | 162/360.2 |
| 5,389,205 A | | 2/1995 | Pajula et al. | 162/205 |
| 5,736,011 A | | 4/1998 | Kade et al. | 162/336 |
| 5,820,731 A | | 10/1998 | Söderholm | 162/203 |
| 5,932,070 A | * | 8/1999 | Esslinger et al. | 162/199 |
| 6,003,750 A | * | 12/1999 | Hermsen | 226/91 |

FOREIGN PATENT DOCUMENTS

| | | |
|---|---|---|
| FI | 93237 | 6/1993 |
| WO | 9713030 | 4/1997 |

* cited by examiner

*Primary Examiner*—Dean T. Nguyen
(74) *Attorney, Agent, or Firm*—Steinberg & Raskin, P.C.

(57) ABSTRACT

The invention relates to a former-press section (100, 110) of a paper machine and to a method of transferring a web from a former to a press section. Between the former section (100) and the press section (110) there is a pre-press zone (PP) which removes water from the web (W) and through which the web (W) is passed as a closed draw from the former section (100) to the press section (110). The upper wet wire (10) or the equivalent transfer wire (10A) of the former section (100) is passed through the pre-press zone (PP), the web (W) being passed on the lower face of said wire into and through the pre-press zone (PP). Inside the loop of the upper wet wire (10) or of the equivalent transfer wire (10A) and/or inside the loop of the lower wet wire (20) there are transfer devices (15, 15*a*, 16, 26) based on the use of a pressure difference. The transfer devices (15, 15*a*, 16, 26) are arranged to operate in connection with threading or an operational malfunction such that the web (W) is separated from the upper wet wire (10) or the equivalent transfer wire.

13 Claims, 3 Drawing Sheets

FORMER-PRESS SECTION IN A PAPER MACHINE AND METHOD FOR TRANSFER OF THE WEB FROM THE FORMER TO THE PRESS SECTION

FIELD OF THE INVENTION

The invention relates to a former-press section of a paper machine in which the former section comprises a lower wet wire and an upper wet wire or an equivalent transfer wire, and in which the press section comprises one or more dewatering press nips, and between which former section and press section there is a pre-press zone which removes water from a web and through which the web is passed as a closed draw from the former section to the press section.

The invention also relates to a method of transferring a paper web from a former section of a paper machine to a press section thereof, which former section is provided with a lower wet wire and with an upper wet wire or with an equivalent transfer wire, and which press section is provided with one or more dewatering press nips, and between which former section and press section water is removed from the web in a pre-press zone through which the web is passed as a closed draw from the former section to the press section.

BACKGROUND OF THE INVENTION

Increased speeds of paper and board machines provide new problems to be solved, which problems are mostly related to the rumnnability of the machine. Currently, speeds of up to from about 1600 to about 1700 meters per minute are employed in paper machines. At these speeds, the so-called closed press sections, which comprise a compact combination of press rolls fitted around a smooth-faced centre roll for the most part still operate satisfactorily. The applicant's Sym-Press II™ and Sym-Press O™ press sections may be mentioned as examples of these press sections.

Dewatering taking place by pressing is more advantageous than dewatering by evaporation from the point of view of energy economy. For this reason, attempts should be made to remove a maximal amount of water from the web by pressing, in order that the proportion of water to be removed by evaporation could be made as low as possible. Increased speeds of paper and board machines, however, provide new, so far unsolved problems expressly for dewatering taking place by pressing because the press impulse cannot be increased sufficiently by the prior art means, above all because at high speeds the nip times remain insufficiently short and, on the other hand, the peak pressure of compression cannot be increased beyond a certain limit without destroying the structure of the web. In addition to the drawbacks mentioned above, the efficiency of the prior art suction rolls is lowered significantly at particularly high web speeds, because the suction does not have sufficient time to act upon the web in the intended manner through the relatively long perforations in the mantle of the suction roll and through non-porous and thick pick-up press felt. This both limits the efficiency of dewatering and makes the transfer of the web more difficult with the help of a vacuum in the suction roll.

With increasing speeds of paper machines, the problems of runnability of a paper machine are also manifested with higher emphasis, because a web with a high water content and low strength does not endure especially the dynamic forces produced by high web speeds and changes in the direction of the web, but rather web breaks and other operational malfunctions arise, causing downtime periods. In modern printing paper machines, the cost of downtime is today about FIM 50,000 per hour.

In the prior art press sections, the web is generally passed from the forming wire into the first press nip on a pick-up felt, which also operates as a press fabric that receives water in the first press nip, which is either a roll nip or an extended nip. In the first press nip, a relatively high compression pressure is employed and large quantities of water are dealt with, and it is one of the drawbacks arising from this that the outer face of the press felt tends to be contaminated and its porous fabric structure tends to be partially blocked. Attempts are made to prevent this by means of efficient felt conditioning devices, which are, however, quite expensive, spacious components which consume an abundance of energy.

Recently, even speeds as high as about 40 meters per second=2400 meters per minute have been contemplated as speeds of printing-paper machines. Applications at speeds as high as this, in particular in wide machines, provide ever more difficult problems to be solved, of which problems the most important ones are runnability and adequate dewatering capacity of the machine at a high web speed. Similarly, in board machines (basis weight of the web>100 grams per square meter) attempts are made to increase the present web speeds (8–15 meters per second) to the level of 15–25 meters per second.

Important drawbacks of the press felts used in the prior art press sections include the effect of rewetting the web and the tendency of contamination, because, in particular when said press felts run through a high-pressure nip or nips, particles of contaminants tend to be affixed and to adhere to the press fabrics, wherefore the operation of the press fabrics is disturbed and their cleaning requires efficient conditioning devices, which consume a considerable amount of energy.

Moreover, in high-pressure press nips, the prior art porous press felts are subjected to intensive wear and strain, so that the felts must be replaced rather frequently, which increases the costs to a considerable extent.

With respect to the prior art related the invention, reference is made to U.S. Pat. Nos. 4,197,158, 4,879,001, 5,308,450 and 5,736,011. The last-mentioned U.S. Pat. No. 5,736,011 discloses a wet end of a paper machine which comprises a headbox of special construction and a twin-wire former on whose upper wire a web is passed as a closed draw to a pick-up point. The US patent does not disclose a pre-press nip nor any pre-pressing stage integral to the present invention. A further difference is that the present invention does not have the special limitations and structural requirements described in the above-mentioned US patent in connection with the headbox. The geometry of the twin-wire former and the transfer of the web from the former to a press section disclosed in the US patent are also substantially different from those of the present invention.

With respect to the prior art most closely related to the invention, reference is made to the applicant's FI patent 98843 (corresponding WO 97/13030 and U.S. Pat. No. 5,792,320). This FI patent discloses a method for removing water from a paper or board web and for passing it as a closed draw from a forming wire or transfer wire of a web former section to a press section. In the method of the FI patent, the web running on the forming wire or on the transfer wire is caused to adhere in a transfer and pre-press zone to the outer face of a transfer belt which is substantially non-water-receiving, and after the pre-press zone, the web is separated substantially immediately from said wire and passed on support of the transfer belt loop onto the next press fabric and/or into the next press nip in the press section.

In addition, the above-mentioned FH patent discloses a press section in which the press section includes a pre-press zone or zones and a transfer belt loop which is substantially non-water-receiving and has an outer face capable of adhesion to the paper web. This transfer belt loop is passed through the pre-press zone, or if two zones are present, at least through the latter zone. In the pre-press zone, the paper web is caused to adhere to the outer face of the transfer belt loop, and after the zone, it is separated substantially immediately from the forming wire without substantial rewetting of the web. On the transfer belt, the web is passed as a closed and supported draw onto the next press fabric and/or through the next press zone in the press section.

In FI patent 98843, a reliable and closed draw of the web is accomplished from the former section to the dryer section without risk of rewetting of the web. Also, in connection with the forming wire or an equivalent transfer wire it is possible to arrange one or more pre-press zones in which the web is caused to adhere reliably to the transfer belt which is substantially non-water-receiving, and moreover, a substantial amount of water is removed, which increases both the dry solids content and the wet strength of the web. This again improves the runnability of the press section and facilitates later stages of dewatering.

Drawbacks of the method and the press section disclosed in the above-mentioned FI patent 98843 include at especially high web speeds in particular difficulties in passing the paper web and the edge strips cut therefrom into a pulper in connection with threading or a disturbance in operation, since in the FI patent, the upper fabric tends to carry the web with it, although the pre-press nip would be even open. This causes web breaks and other operational malfunctions in the press section.

With increasing speeds of paper machines, the above-noted web transfer, pick-up and dewatering capacity problems and other difficulties associated with them are aggravated.

An object of the present invention is to develop further the method for transferring and pressing a paper web and the press section disclosed in the above-mentioned FI patent 98843 so that the advantages attainable by the FI patent are also retained in the present invention.

OBJECTS AND SUMMARY OF THE INVENTION

An object of the present invention is to provide a new combination of a former and a press section of a paper machine as well as a method in the transfer of a web from the former section to the press section so that the above-noted drawbacks are mainly avoided and the other objects of the invention explained later are achieved.

With a view to achieving the objects stated above and those which will come out later, the former-press section in accordance with the invention is mainly characterized in that said upper wet wire or an equivalent transfer wire of the former section is passed through said pre-press zone, the web being passed on the lower face of said wire into and through said pre-press zone, that inside the loop of said upper wet wire or of said equivalent transfer wire and/or inside the loop of a lower wet wire there are transfer devices based on the use of a pressure difference, by means of which transfer devices it is ensured in a normal situation of operation that the web is separated from the lower wet wire and follows the upper wet wire or the equivalent transfer wire and runs on the lower face of said wire further into the pre-press zone, and that said transfer devices based on the use of a pressure difference can be arranged to operate in connection with threading or an operational malfunction such that the web is separated from the upper wet wire or the equivalent transfer wire and falls down into a wire pit, pulper or equivalent situated underneath.

The method in accordance with the invention is in turn mainly characterized in that, after forming of the web or at its final stage, a pressure difference is applied to the web through said wet wires and through a transfer wire, if any, by means of particular pressure difference devices such that the pressure acting on the web is arranged in said pressure difference devices to be higher on the side of an upper wet wire or an equivalent transfer wire with the result that, in connection with threading or an operational malfunction, the web is passed to follow a lower wet wire, and said pressure is arranged to be higher on the side of the lower wet wire with the result that, in a normal situation of operation, the web is passed to follow the upper wet wire or an equivalent transfer wire.

By means of the method and the device of the invention the web is made to reliably follow the upper wet wire or an equivalent transfer wire in a normal situation of operation directly into a pre-press zone or, alternatively, in case of a disturbance in operation or in connection with threading, the web is made to reliably follow the lower wet wire before the pre-press zone so that the web and its edge strips do not cause disturbance in the pre-press zone and in the press zones proper following after it. The devices based on a difference in pressure in accordance with the invention enable said transfer to be efficiently ensured because the permeability of the wet wire or wires and the transfer wire, if any, is relatively high and thus, through it, the effect of a pressure difference can efficiently be applied to the web without excessive energy consumption or other disturbing factors. In the pre-press zone applied in the invention, because of the above-mentioned high permeability of the wires, considerable amounts of water can be removed using a moderate amount of energy so that the web can be passed even at high speed in a reliable manner to the press section proper and through it and further to a dryer section. Moreover, the formation of the web and its z-direction distributions can still be affected efficiently in the pre-press zone.

BRIEF DESCRIPTION OF THE DRAWINGS

In the following, the invention will be described in detail with reference to some exemplifying embodiments of the invention shown in the figures of the accompanying drawing, to the details of which embodiments the invention is not by any means narrowly confined.

DETAILED DESCRIPTION OF THE INVENTION

Figure 1:
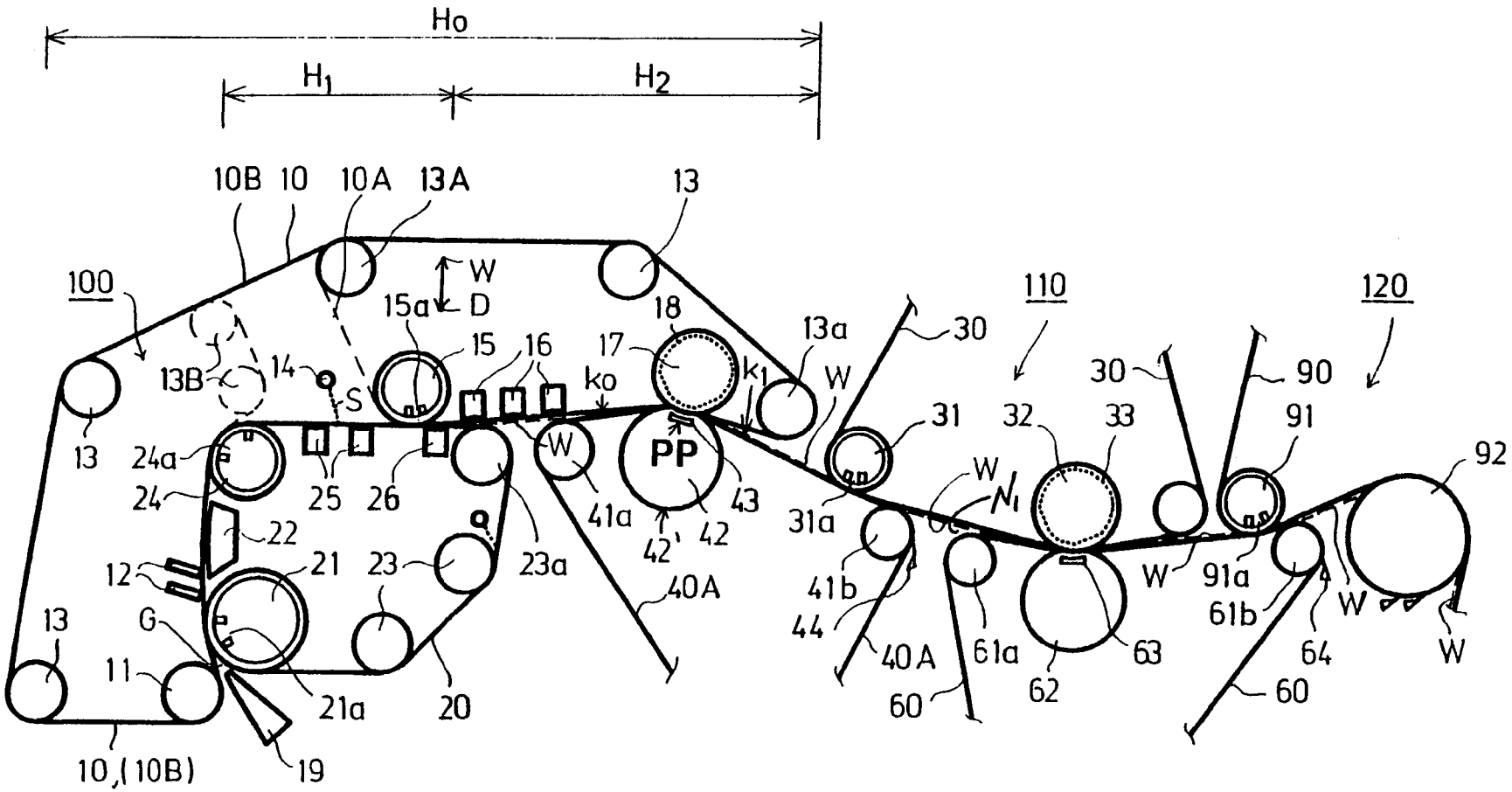
FIG. 1 is a schematic side view of a first embodiment example of the invention.
Figure 2:
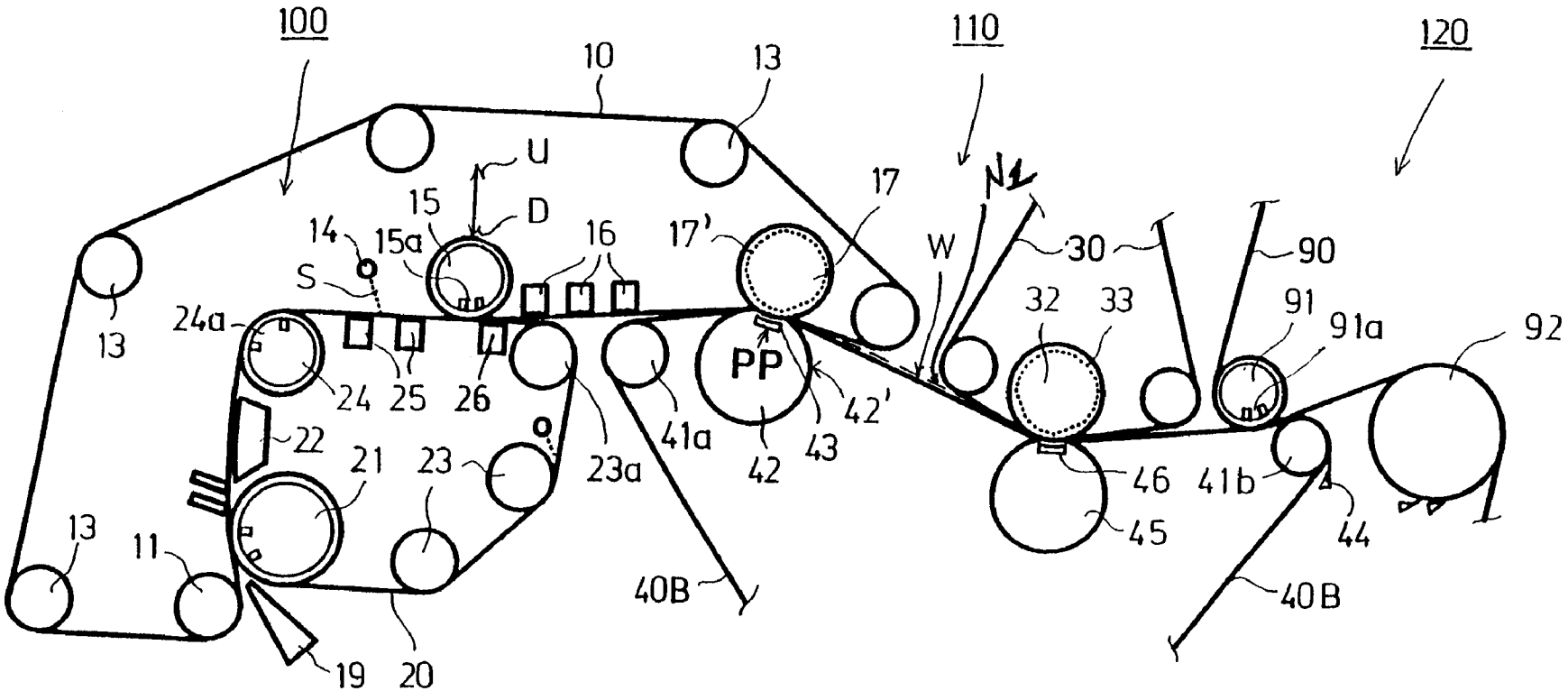
FIG. 2 shows, in a manner corresponding to that of FIG. 1, an embodiment of the invention in which a paper web is passed from a pre-press nip of an upper wet wire as a closed draw through the entire press section on a lower impermeable transfer belt.
Figure 3:
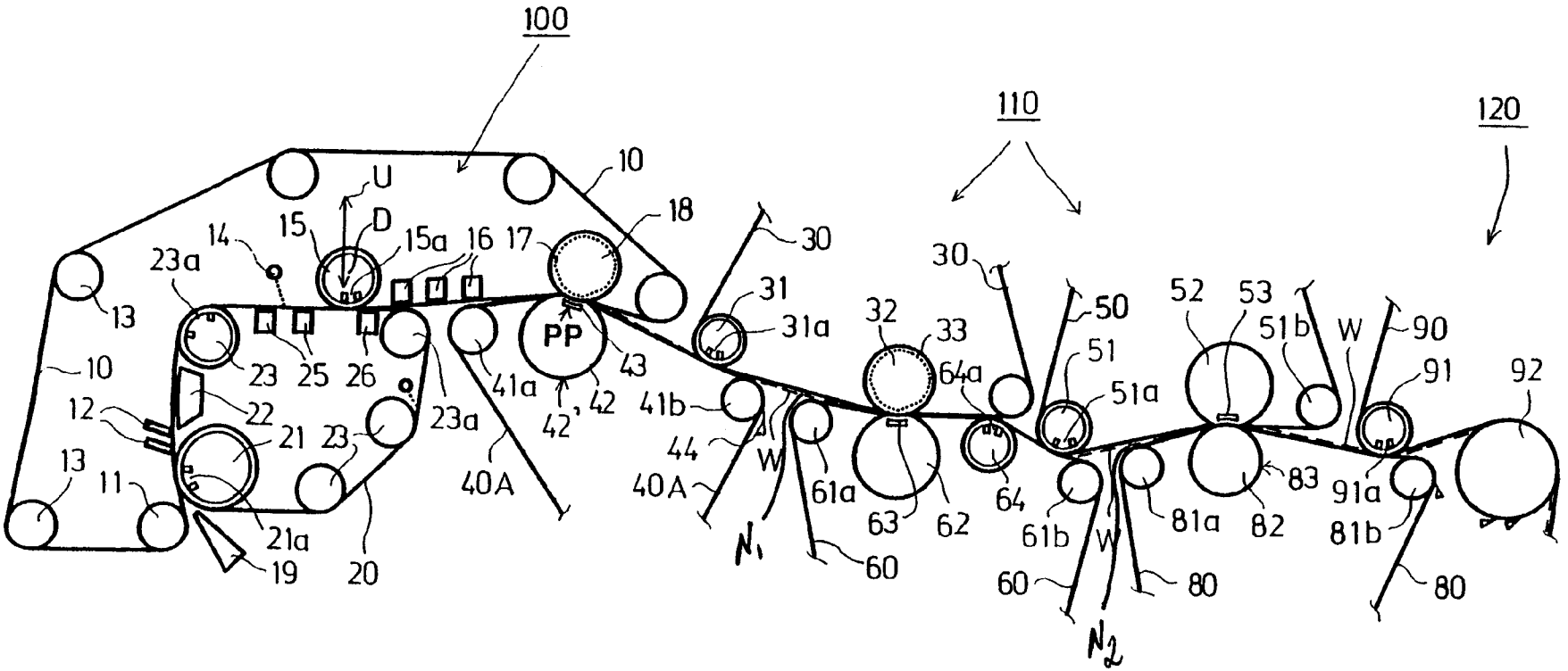
FIG. 3 shows, in a manner corresponding to that of FIGS. 1 and 2, an embodiment of the invention in which a pre-press nip in a press section is followed by two successive two-fabric extended-nip presses.

The general arrangement and the common structural features of the former and the press section shown in FIGS. 1, 2 and 3 are described below.

The paper machine schematically shown in FIGS. 1, 2 and 3 comprises a former section 100, a press section 110 and a dryer section 120, only the initial end being shown of the last-mentioned section.

The former section 100 shown in FIGS. 1–3 is a twin-wire former comprising an upper wet wire 10 and a lower wet wire 20. The wires 10, 20 define between them a twin-wire zone which begins from a forming gap G, into which a pulp suspension jet is supplied from a discharge opening of a headbox 19. After the forming gap G, the twin-wire zone curves in a small curve sector over a suction zone or zones 21a of a first forming roll 21 situated inside the loop of the wire 20. In the twin-wire zone there are after that forming members 12, for instance, a so-called MB unit, placed inside the loop of the upper wire 10, which MB unit comprises successive rib elements known per se and loadable against one another by loading hoses.

The upper wet wire 10 is guided by a breast roll 11 and guide rolls 13. The forming members 12 are followed by a forming shoe 22 situated inside the loop of the lower wet wire 20, which forming shoe has a curved ribbed deck, and after that there is a second upper forming suction roll 24 on whose suction zone 24*a* the twin-wire zone curves changing from vertical to horizontal.

As shown in FIGS. 1–3, in the horizontal run of the twin-wire zone there are suction devices 25 and 26 inside the loop of the lower wet wire 20, and between them there is a suction device 15 inside the loop of the upper wet wire 10. The suction device is shown to be a suction roll having a suction zone 15*a*. After the suction device inside the wet wire 10 there are three successive suction flatboxes 16, before which a web W has already been separated from the lower wire 20, when the web W is passed from the former section 100 to the press section 110 in the normal manner. The suction flatbox 26 situated inside the lower wire loop 20 after the suction device 15 is followed by a guide roll 23*a* which guides the lower wire 20 apart from the web W and from the upper wire 10. The lower wire 20 is otherwise guided by its guide rolls 23 on its return run.

Although in the embodiment of the invention illustrated in FIGS. 1, 2 and 3 the former is expressly a twin-wire former, it shall be understood that the method of the invention and the combination of the former section and the press section may also be applied when the former is, for example, a hybrid former having a single-wire initial portion or a multi-layer former or even a Fourdrinier former which is provided with an upper wet and/or transfer wire, which corresponds to the above-noted upper wet wire 10 while the lower wire is a normal Fourdrinier wire 20. With respect to the different former concepts in connection with which the invention may be applied, reference is made, as some non-limiting examples, to the formers described in the applicant's above-mentioned FI patent 98843.

In FIG. 1, the largest horizontal machine-direction extension of the former section 100 is designated by $H_0$, the corresponding horizontal extension of the twin-wire zone is designated by $H_1$, and the corresponding extension of the upper wet wire loop 10 from the end of the twin-wire zone to the outermost guide roll 13*a* is designated by $H_2$. It is typical of the geometry of the former, specifically a twin-wire former, in accordance with the invention that the horizontal extension of the upper wet wire loop 10 after the twin-wire zone is relatively large, and preferably $H_2 > H_1$ or $H_2 \approx H_1$ and generally $H_2 \approx (2-4) \times H_0$.

In accordance with the invention, the upper wet wire 10 takes the web W on its lower face to a pre-press nip PP. The pre-press nip PP is formed between a press roll 17, which is situated within the upper wire loop 10 and provided with a recessed face 18 (a smooth-faced roll is also possible), and a lower shoe roll 42 provided with a flexible hose mantle. Thus, the pre-press nip PP is an extended nip whose compression load is produced by hydraulically loading a press shoe 43 inside the mantle of the shoe roll 42 against the back-up roll 17.

As FIGS. 1–3 show, the web is separated after the pre-press nip PP substantially immediately from the upper wet wire 30 in order to prevent rewetting by attaching the web W to the smooth and adhesive outer face of a lower transfer belt 40A,40B, on which the web is transferred without substantial rewetting because the transfer belt 40A;40B is not substantially water-receiving.

The press section shown in FIGS. 1 and 2 includes as the press nip proper one press nip $N_1$, which is formed between an upper press roll 32 provided with a recessed face or with a smooth face 33 and a lower shoe roll 62 provided with a flexible hose mantle. The loading of the extended-nip zone in the nip $N_1$ is produced by means of a hydraulic press shoe 63 situated inside the hose mantle of the shoe roll 62.

In FIG. 3 there is, in addition to the extended-nip zone 61 described above, a second extended-nip zone $N_2$, which is formed by a lower press roll 82 provided with a smooth mantle face 83 and by an upper shoe roll 52 provided with a flexible hose mantle and having a press shoe 53 at the extended-nip zone $N_2$.

One characteristic feature of the paper machine shown in FIGS. 1—3 is that the paper web W has a very linear run from the beginning of the twin-wire zone and even from the second forming roll 24 up to a drying wire 90 so that the largest angle of the change of direction of the web W on this run is of the order of 10–20°, said angle of the change of direction being preferably smaller than about 15°. Partly owing to this feature, the web W will have a trouble-free and reliable transfer even at very high web speeds In connection with the beginning of threading or when there has occurred a disturbance in operation, the web W can be passed from the former 100 down into a wire pit (not shown) or into an equivalent pulper before the web W is transferred into the pre-press nip PP and to the press section 110. When the web W is desired to be passed down into a wire pit or into a pulper, the travel of the web W on the face of the lower wet wire 20 is ensured by means of vacuums in the suction devices 26 situated inside the loop of the lower wet wire 20 and, at the same time, the travel of the web W with the upper wet wire 10 is prevented by closing the vacuum zone 15*a* of the transfer suction device 15 or even by means of a positive pressure introduced into it 15*a*. When the web W is desired to be passed into the pre-press nip PP and, at the same time, further into the press nips proper $N_1$;$N_1$,$N_2$ of the press section 110, a vacuum is quickly connected to the suction zone 15*a* of the transfer suction device 15 and simultaneously, when needed, the vacuum level in the suction device 26 can be additionally lowered. The web W will then follow the upper wet wire 10 up to the pre-press nip PP. The pick-up procedure described above can also be performed by a lowering movement of the transfer suction device 15, which is illustrated by the arrow U-D. The lowering and raising movement (U-D) of the transfer suction device 15 is produced in both edge areas of said device by means of power devices, such as hydraulic cylinders or equivalent fitted, for instance, in connection with both bearing supports of the transfer suction roll 15.

Since the permeabilities of the wet wires 10,20 or of the corresponding transfer wire 10A and the lower wet wire 20 are inherently fairly high, an efficient pressure difference effect can be applied through them for guiding the travel of the web W so as to follow either the upper wet wire 10 or the equivalent transfer wire 10A or the lower wet wire 20 according to the requirements of the operating situation at any given time. In addition, dewatering through the upper wet wire 10 or the equivalent transfer wire 10A in the pre-press zone PP is efficient for the same reasons. The air permeabilities of the wires 10,20;10A,20 are typically in the range of from 3000 to 8000 $m^3/m^2/h$ when the pressure difference is 100 Pa.

The lower fabric running through the pre-press nip PP is a transfer belt 40A,40B which is substantially impermeable to water and which has such a running path that the web W passed on its face from the pre-press nip PP can be separated, in case of a break or in connection with starting of the machine or in connection with threading of the web W, by means of a doctor 44 from the transfer belt 40A,40B and passed down into a pulper (not shown) or equivalent. This means in practice that, in the pre-press nip PP, the wet wire 10 is substantially in an upper position and the transfer belt 40A,40B is substantially in a lower position.

Although in the foregoing and in the following reference is made to the upper wet wire 10 and to the lower wet wire 20, the concept of the former section 100 may also differ in this respect from those shown in the figures, and the run of the upper wire loop 10 taking the web W from the twin-wire zone into the pre-press nip PP need not be horizontal, but, instead, it may alternatively be either obliquely upwards or obliquely downwards.

In the twin-wire zone before the transfer device 15 there are water cutting means 14 from which water jets S are directed through the wire 10 for cutting edge strips from both edges of the web W so as to produce a flawless web W of uniform width whose width is precisely determined. The cutting width of the web W can be arranged to be adjustable by adjusting the location of the water cutting means 14 in a transverse direction in a manner and by devices known in themselves. The water cutting of the edges of the web W and the adjustable suction width of the transfer suction device 15 enable a web W with good edges to be passed into the pre-press nip PP and into the press nips proper. The edge strips of the web W are passed with the lower wet wire 20 into a wire pit (not shown).

In accordance with the method of the invention, when the web W is between the two wires 10,20, it is transferred onto the lower face of the upper wire 10 and on it forwards. The beginning of the transfer of the web W can be accomplished such that, when the web W follows the lower wire 20, the upper wire 10 and the suction roll 15 are brought into contact with the lower wire 20 and the web W is then transferred onwards together with the upper wire 10. When the web W is desired to be passed into a pulper, the suction roll 15 on the side of the upper wire 10 can also be lifted up (arrow U-D). The transfer may also be carried out the other way round: when the web W follows the upper wire 10, the web W is guided into the pulper by raising the lower wire 20 and a suction roll (not shown) placed inside it into contact with the web W. The preferable transfer alternative is the latter one in which the web W normally follows the upper wire 10. In that case, the web W can be passed directly after forming into the pre-press nip PP, and the web W need not be transferred in the wire section from one fabric onto another.

FIGS. 1, 2 and 3 depict the pre-press nip PP expressly as an extended nip which is formed between the shoe roll 42 and the upper press roll 17. The press roll 17 preferably has a recessed face 18 or the roll 17 is a suction roll and, when needed, an adjustable-crown roll. The lower shoe roll 42 in the pre-press nip PP has a hose mantle 42' provided with a smooth outer face. Although the pre-pressing PP is preferably carried out by an extended-nip press, a roll nip is also possible as the pre-press PP. The pressing stages proper are also preferably carried out by means of extended-nips $N_1$;$N_1$,$N_2$, but, alternatively, a roll nip or roll nips are possible.

The object of pre-pressing PP is to raise the dry solids content of the web W before the web W is transferred into the press nips proper $N_1$;$N_1$,$N_2$ but, since pressing is started in the pre-press nip PP at a fairly low dry solids content $k_0 \approx 10–15\%$, the formation of the web W may also be improved by mean of pre-pressing. In the pre-press nip PP, the formation of the web W may be affected by working the fibre mesh of the web at the stage where the web W is already relatively frozen. The structure of the web W can then be worked by means of the relatively high compression pressures used in the pre-press nip PP, and shearing stresses can be produced in the web W by means of pressure. with the result that fibre flocs will disintegrate and become loose, and it is possible for the fines to be displaced in the web, which has a favourable effect on the z-direction distributions in the structure of the web W.

A substantial amount of dewatering also takes place in the pre-press nip PP so that the dry solids content of the web can be raised from the above-mentioned value $k_0$ to the value $k_1 \approx 18–35\%$.

The transfer of the paper web W from the former 100 up to the dryer section 120 preferably takes place as a closed draw.

The structural features differing from one another in different FIGS. 1, 2, and 3 are described in the following.

In FIG. 1, the web W is transferred from the pre-press nip PP on the face of the lower transfer belt 40A, and from it by means of a vacuum in a suction zone 31*a* of a transfer suction roll 31 onto the face of the upper felt 30 and further into the press nip $N_1$. One of the press fabrics in the nip $N_1$ is a lower transfer belt 60, on whose upper face the web W is transferred from the nip $N_1$ to a point where the web W is transferred by means of a vacuum in a suction zone 91*a* of a transfer suction roll 91 onto a drying wire 90 and on it to cylinder drying 92 or equivalent. In FIG. 1, the first guide roll of the lower transfer belt 40A is denoted with the reference 41*a* and the last guide roll thereof with the reference 41*b*, in a corresponding way, the first guide roll of the second transfer belt 60 is denoted with the reference 61*a* and the last guide roll thereof with the reference 61*b*, and there is a doctor 64 in connection with the guide roll 61*b*.

The embodiment shown in FIG. 2 corresponds to that of FIG. 1 except that both the re-press nip PP and the single-felted press nip proper $N_1$, provided with an upper felt 30 are formed against the same transfer belt 40B. In FIG. 2, the horizontal run of the lower transfer belt 40B extends from its guide roll 41*a* situated before the pre-press zone PP through the extended-nip press $N_1$ to its last guide roll 41*b*, in whose connection there is a doctor 44.

The embodiment shown in FIG. 3 corresponds to that of FIG. 1 except that the pre-press nip PP is followed by a double-felted 30,60 first press nip proper $N_1$ of the press section and it is followed by a second press nip $N_2$ provided with one dewatering felt 50 and with a transfer belt 80. In FIG. 3, the lower felt passing through the first extended-nip zone $N_1$ extends from its first guide roll 61*a* to its last guide roll 61*b*, and the web W is separated from the upper felt 30 on a suction zone 64 of a transfer suction roll 64 and transferred on the lower felt 60 onto an upper felt 50 of the second extended nip $N_2$ on a suction zone 51*a* of a suction transfer roll 51 situated inside the loop of the upper felt 50, said suction zone taking the web W into the second extended nip $N_2$. The lower fabric of this extended nip $N_2$ is a transfer belt 80, whose horizontal run extends from its first guide roll 81*a* to its last guide roll 81*b*.

In the figure, dashed lines denote with the reference 10A an alternative run of a special transfer wire from a guide roll 13A to the transfer suction roll 15. In that case, there is no upper wet wire 10 or, when the twin-wire former 100 is used, the run of an upper wire 10B is like the one indicated with the reference 10B and with guide rolls 13B. However, it may be emphasized in this connection that the best embodiment of the invention is the one which expressly uses a twin-wire former and an upper wet wire 10 and a lower wet wire 20 as well as a pre-press zone PP in the manner shown in FIGS. 1–3 or in a corresponding way.

The claims are presented in the following and the various details of the invention may vary within the inventive idea defined in said claims and differ from the disclosure given above by way of example only.

What is claimed is:

1. A method for transferring a paper web (W) from a former paper section (100) of a paper machine to a press section (110) thereof, said former section (100) having a lower wet wire loop (20) and an upper wet wire loop (10), said lower wire and said upper wet wire defining a twin-wire forming zone, said press section having at least one dewatering press nip ($N_1$; $N_1$,$N_2$), and a pre-press zone (PP) structured and arranged between said former section (100) and said press section (110) for removing water from said web (W) passing therethrough as a closed draw from said former section (100) to said press section (110), comprising the steps of:

providing at least a first pressure difference device (15, 16) interiorly of said loop of said upper wet wire and at least a second pressure difference device (26) interiorly of said loop of said lower wet wire for applying a pressure to said paper web (W); and applying a pressure difference to said paper web (W) through said lower wet wire (20) and said -upper wet wire (10) after the formation of said paper web (W), such that, a higher pressure is applied on one of:

a side of said upper wet wire (10) in order for said paper web (W) to follow said lower wet wire (20) during a threading operation or during an operational malfunction, and a side of said lower wet wire (20) in order for said paper web (W) to follow along said upper wet wire (10) during normal operating conditions.

2. The method according to claim 1, wherein when said web (W) is desired to be passed into a wire pit, comprising the step of:

ensuring the run of the web (W) remains on the face of the lower wire web (20) by means of vacuums created through suction devices (26) structured and arranged inside a loop of said lower wet wire (20), and simultaneously preventing the run of the web (W) along said upper wet wire (10) by one of closing a vacuum zone (15*a*) of one of said pressure difference devices (15) and introducing a positive pressure on to said upper wet wire (10).

3. The method according to claim 1, further comprising the steps of:

connecting a vacuum to a suction zone (15*a*) of a transfer suction device (15) structured and arranged inside a loop of one of said upper wet wire (10) when said web (W) is transferred into a pre-press zone (PP) and simultaneously into one of a press nip ($N_1$) and a plurality of press nips ($N_1$,$N_2$); and simultaneously, when needed, lowering the vacuum level in a suction device (26) structured and arranged in said lower wet wire (20) such that said web (W) follows said upper wet wire (10) into said pre-press zone (PP).

4. The method according to claim 1, further comprising the steps of:

separating said paper web (W) after said pre-press zone (PP) form said upper wet wire (10); and passing said paper web (W), as a closed draw, on an upper face of a substantially non-water-receiving transfer belt (40A,40B) onto a lower face of an upper fabric (30) of a following press nip ($N_1$), in a machine running direction, through said press nip ($N_1$) onto a drying wire (90) of a dryer section (120) structured and arranged after said press section (110) in a machine running direction.

5. The method according to claim 4, wherein said following press nip ($N_1$) is one of a suction roll transfer (30,31*a*) and a closed draw on said upper face of said transfer belt (40B).

6. The method according to claim 1, further comprising the steps of:

applying said pressure difference to said web (W) through said upper wet wire (10) and said lower wet wire (20) when said web (WO has a dry solids level in the range of about 10% to about 15%; and raising said dry solids level of said web (W) in said pre-press zone (PP) to a range of about 18% to about 35%.

7. A former-press section of a paper machine comprising:

a former section having a lower wet wire arranged in a loop and an upper wet wire arranged in a loop, said lower wet wire and said upper wet wire defining a twin-wire forming zone;

a press section having at least one detwatering nip;

a pre-press zone arranged between said former section and said press section which removes water from a web passed as a closed draw from the former section to the press section;

wherein said upper wet wire is structured and arranged to pass through said pre-press zone and said web is on a lower face of said upper wire;

at least a first transfer device arranged interiorly of said loop of said upper wet wire and at least a second transfer device arranged interiorly of said loop of said lower wet wire, said transfer devices being structured and arranged to generate a pressure difference to ensure that during normal operation of said paper machine said web separates from said lower wet wire and follows said upper wet wire on a lower face thereof into said pre-press zone and wherein during one of threading and operational malfunction conditions of said paper machine said transfer devices are structured and arranged to insure that said web is separated from said upper wet wire and falls down into one of a wire pit, pulper and equivalent situated underneath said upper wet wire.

8. The former-press section according to claim 7, further comprising a substantially non-water-receiving transfer belt arranged to run through said pre-press zone said transfer belt being structured and arranged to cause said web to separate from said upper wet wire and adhere to an upper face of said transfer belt in said pre-press zone.

9. The former-press section of claim 8, further comprising:

a water receiving upper press felt arranged after the pre-press zone in a running direction of said paper machine;

a suction roll structured and arranged to transfer said web from said substantially non-water-receiving transfer belt to a lower face of said water receiving upper press felt;

a first dewatering press nip arranged after said suction roll in a running direction of said paper machine through which said web on said upper press felt passes;

a lower press felt structured and arranged so that lower press felt and said upper press felt define a closed draw after said first dewatering press nip web, and wherein said lower press felt is structure arranged to carry said web on an upper face thereof after said first dewatering nip and wherein said lower press felt is structured and arranged to pass said web onto a drying wire of a dryer section of said paper machine.

10. The former-press section according to claim 8, further comprising:

a nip arranged after said pre-press zone;

wherein said substantially non-water-receiving transfer belt is structured and arranged to pass through said nip.

11. The former-press section according to claim 7, further comprising a suction transfer device arranged inside said loop of said upper wire and wherein said suction transfer device is structured and arranged to generate a vacuum effect to ensure that said web follows said upper wet wire into said pre-press zone.

12. The former-press section of claim 11, further comprising a suction box arranged substantially immediately after said suction transfer device in a running direction of said paper machine and wherein said suction box is arranged within said loop of said lower wire and is structured and arranged to ensure that said web follows said lower wire during said threading and operational malfunction conditions.

13. The former-press section of claim 7, further comprising at least one suction box arranged inside the loop of the upper wet wire.

* * * * *